US006182384B1

(12) United States Patent
Gaspard

(10) Patent No.: US 6,182,384 B1
(45) Date of Patent: Feb. 6, 2001

(54) WHEELED GRADING BUCKET

(76) Inventor: Martin Gaspard, 8276 Highway 418, Batchelor, LA (US) 70715

( * ) Notice: Under 35 U.S.C. 154(b), the term of this patent shall be extended for 0 days.

(21) Appl. No.: 09/198,901

(22) Filed: Nov. 24, 1998

(51) Int. Cl.[7] ..... E02F 3/64
(52) U.S. Cl. ..... 37/411; 37/412; 37/435
(58) Field of Search ..... 37/411, 412, 415, 37/416, 424, 425, 435

(56) References Cited

U.S. PATENT DOCUMENTS

| | | | | |
|---|---|---|---|---|
| 2,063,698 | * | 12/1936 | Roe | 37/129 |
| 2,111,134 | * | 3/1938 | Allin | 37/412 |
| 2,223,829 | * | 12/1940 | Le Bleu | 37/424 |
| 2,255,240 | * | 9/1941 | Bird | 37/424 |
| 2,269,502 | * | 1/1942 | Wilson et al. | 37/411 |
| 2,273,875 | * | 2/1942 | Livesay et al. | 37/435 |
| 2,280,439 | * | 4/1942 | McLean | 37/424 |
| 2,329,210 | * | 9/1943 | McGee | 37/411 |
| 2,350,327 | * | 6/1944 | Ender | 37/126 |
| 2,398,991 | * | 4/1946 | Arps | 37/435 |
| 2,443,884 | * | 6/1948 | Arps | 37/412 |
| 2,529,159 | * | 11/1950 | Hyler | 280/33.13 |
| 2,554,698 | * | 5/1951 | Evans | 37/424 |
| 2,587,869 | * | 3/1952 | Marshall | 37/435 |
| 2,788,138 | * | 4/1957 | Stueland | 37/435 |
| 3,427,735 | * | 2/1969 | Martin | 37/412 |
| 3,445,946 | * | 5/1969 | Striggow | 37/412 |
| 3,483,644 | * | 12/1969 | Potgieter | 37/424 |
| 3,501,856 | * | 3/1970 | Martin | 37/126 |
| 4,308,677 | | 1/1982 | Behm | 37/126 AE |
| 4,389,800 | | 6/1983 | Goby | 37/124 |
| 4,906,161 | | 3/1990 | Weyer | 414/705 |
| 5,145,313 | | 9/1992 | Weyer | 414/723 |
| 5,265,355 | * | 11/1993 | Daniels | 37/231 |

* cited by examiner

*Primary Examiner*—Thomas B. Will
*Assistant Examiner*—Kristine M. Markovich
(74) *Attorney, Agent, or Firm*—Howrey Simon Arnold & White, LLP

(57) ABSTRACT

A tiltable bucket assembly having a working edge on the leading end of the bucket and a forward extending extension arms, a pair of support arms, a pair of first wheels, a pair of second wheels, a pair of bucket-rotational members, a bucket-pivoting member, a bucket-linking arm, and a displacement body having an output shaft disposed therein. The support arms are connected at one end to each corresponding first wheel and extend forward from the corresponding first wheel. The extension arms are connected to the support arms at a point away from the first wheels. The bucket-rotational members are attached at one end to the bucket at a point away from the working edge. The other end of the bucket-rotational members are linked to the corresponding first wheels so that vertical displacement of the first wheels result in a substantially equivalent vertical displacement of the other end of the bucket-rotational members. The bucket-linking arm is coupled at one end to the bucket at a rotational center-point positioned above the working edge. The output shaft is coupled at one end to the bucket-pivoting member while the other end moves within the displacement body. The bucket assembly is designed for use with a vehicle to grade an area of land, accumulating the soil which can be conveyed to a different location where it can be dispensed. The grading, conveying, and dumping of the soil is achieved through the rotation of the bucket. When in the conveying mode, the bucket assembly rides on the second wheel.

12 Claims, 5 Drawing Sheets

WHEELED GRADING BUCKET

FIELD OF THE INVENTION

The present invention relates generally to an apparatus for excavating and moving earth and, more particularly, to a tiltable bucket that rides on wheels and is adaptable for pulling behind a tractor.

BACKGROUND OF THE INVENTION

The excavation of earth, including soil, rock, and other matter, is a task common to numerous enterprises, particularly farming. In farming operations, it is often necessary to grade the land, remove soil from raised areas, and fill in soil in lower areas. Various equipment have been employed to achieve these ends.

Backhoes and other similar vehicles, for example, have an extendible arm adapted for attachment to a bucket. The backhoe with the attached bucket can be used to excavate soil from a first location. The backhoe can then be moved to a second location where the soil can be dumped. The size of the bucket in such backhoes and similar vehicles, and therefore the amount of soil that can be worked at one time, is generally small relative to the overall size of the vehicle. This is because the entire weight of the arm, bucket, and soil is born by the vehicle.

Previous equipment were deficient in that they were not designed to remove a relatively small depth of soil (e.g., a few inches) from a relatively large area. They were not designed for grading. Rather, such equipment were principally designed for removing a quantity of soil, roughly equivalent to the capacity of the bucket, from a small area. Similarly, previous equipment have not been designed to evenly distribute the accumulated soil over a relatively large area such that the maximum increase in soil depth in any one location is controlled. There is a need therefore for an efficient farming implement capable of removing a relatively small depth of soil from a relatively large area and transporting the accumulated soil to a second area where the soil can be either dumped or spread out.

SUMMARY OF THE INVENTION

In accordance with one aspect of the invention, there is provided a tiltable bucket assembly with a working edge on the leading end of the bucket and a forward extending extension arm, a support arm, a first wheel, a bucket-rotational member, a bucket-pivoting member, a bucket-linking arm, and a displacement body having an output shaft disposed therein. The support arm is connected at one end to the first wheel and extends forward from the first wheel. The extension arm is connected to the support arm at a point away from the first wheel. The bucket-rotational member is attached at one end to the bucket at a point away from the working edge. The other end of the bucket-rotational member is linked to the first wheel so that vertical displacement of the first wheel results in a substantially equivalent vertical displacement of the other end of the bucket-rotational member.

The bucket-linking arm is coupled at one end to the bucket at a rotational center-point positioned above the working edge. The output shaft is coupled at one end to the bucket-pivoting member while the other end moves within the displacement body. Movement of the output shaft causes the rotation of the bucket and therefore the transitioning of the assembly between a grading mode, a dumping mode, and a conveying mode.

In the grading mode, the leading edge normally engages a surface to be worked with the output shaft positioned in a normal position. Decreased displacement of the output shaft from the normal position causes the clockwise rotation of the bucket around the rotational center-point into the dumping mode. Increased displacement of the output shaft from the normal position causes the counter-clockwise rotation of the bucket around the rotational center-point into the conveying mode.

In accordance with another aspect of the invention, a tiltable bucket assembly is provided that additionally has a second wheel that is positioned away from the leading edge and preferably adjacent the point where the bucket-rotational member is attached to the bucket. The second wheel is positioned such that when the bucket is rotated into the conveying mode the second wheel is in contact with the surface to be worked.

In accordance with still another aspect of the invention, a tiltable bucket assembly is provided that additionally has both a second wheel and a third wheel. The second wheel is again positioned away from the leading edge and adjacent the point where the bucket-rotational member is attached to the bucket such that when the bucket is rotated into the conveying mode the second wheel is in contact with the surface to be worked. The third wheel is connected to the support arm at a point away from the first wheel. The bucket-rotational member is attached at one end to the bucket at a point away from the working edge while the other end is rotatably attached to the support arm.

BRIEF DESCRIPTION OF THE DRAWINGS

While the invention is susceptible to various modifications and alternative forms, specific embodiments have been shown by way of example in drawings and will be described in detail herein. However, it should be understood that the invention is not intended to be limited to the particular forms disclosed. Rather, the invention is to cover all modifications, equivalents, and alternatives falling within the spirit and scope of the invention as defined by the appended claims.

DESCRIPTION OF ILLUSTRATIVE EMBODIMENTS

Figure 1:
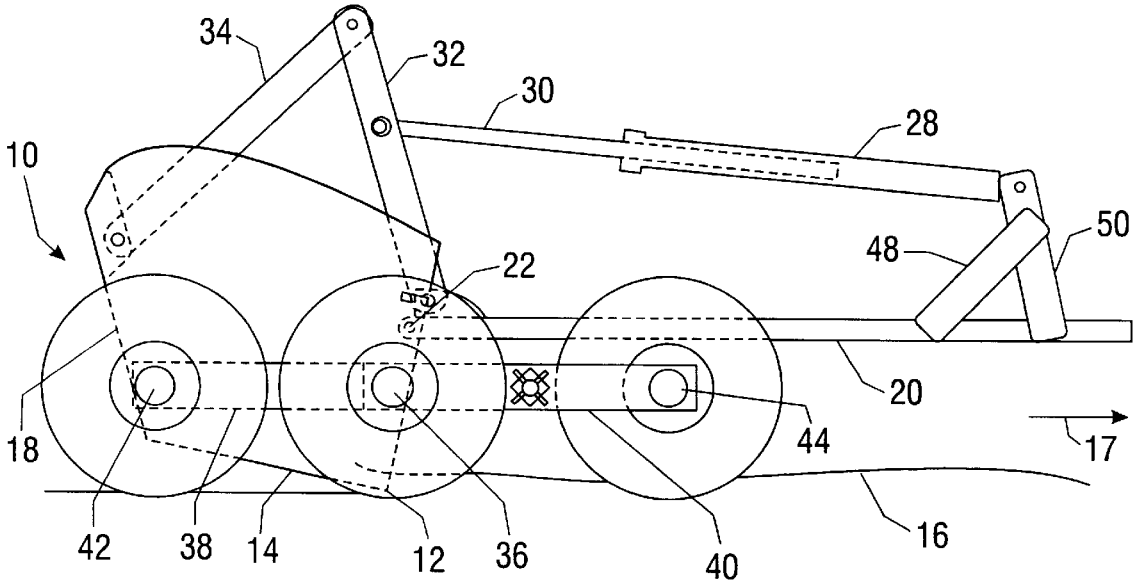
FIG. 1 is a depiction from the side of one embodiment of the tiltable bucket assembly in the grading mode.

In accordance with an embodiment of the invention, there is provided a tiltable bucket assembly that is adapted for pulling behind a vehicle, such as a tractor. The bucket assembly has a bucket 10 with a working edge 12 on the leading end of a bottom wall 14. When the working edge 12 is positioned in contact with a surface to be worked 16 and the bucket 10 is pulled forward, as indicated by the arrow 17, by the vehicle, the working edge 12 digs into the surface 16 causing soil and other material to be dislodged. Because of the forward movement of the bucket assembly 10, the dislodged soil accumulates in the space defined by the bottom wall 14 and retaining wall 18.

Figure 5:
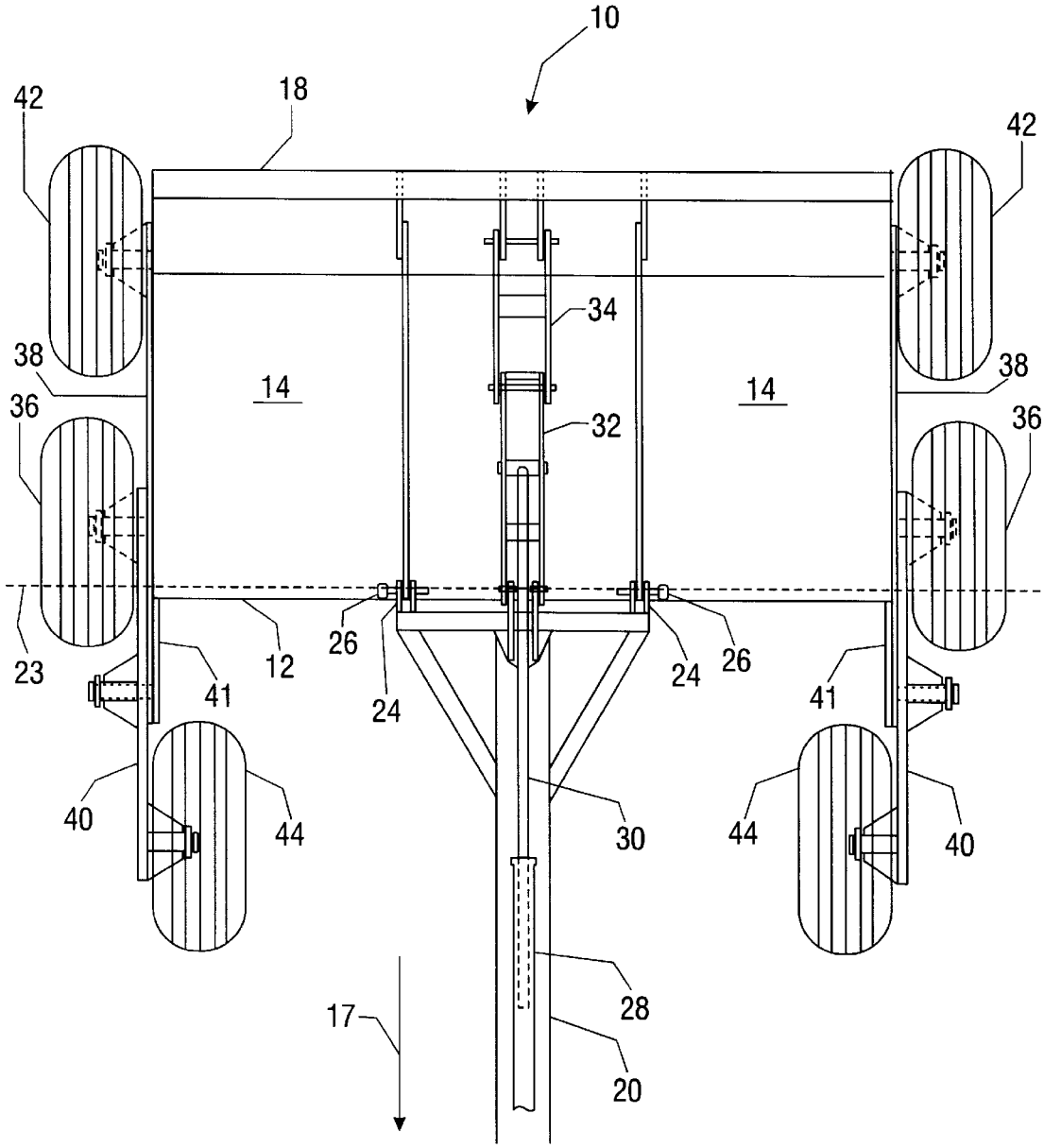
FIG. 5 is an overhead depiction of one embodiment of the tiltable bucket assembly.

A bucket-linking arm 20, adapted at one end for connection to a vehicle, is rotatably connected at the other end to the bucket 10 at a rotational center point 22. The mechanism of connection between the other end of the bucket-linking arm 20 and the rotational center point 22 must allow for rotation of the bucket around a horizontal axis 23 passing thorough the rotational center point 22. Such can be assured as illustrated in FIG. 5 with the use of the combination of a bucket-linking arm 20 having a clevis 24 at its end and a pin 26. Also as illustrated in FIG. 5, connection of the bucket-linking arm 20 to the bucket 10 can occur at multiple rotational center points, each residing on the same horizontal axis 23. Multiple connections at multiple rotational center points is indeed preferred as such an arrangement adds stability to the bucket assembly. Rotation of the bucket 10 around the horizontal axis 23 passing through the rotational center point 22 causes the assembly to be alternatively transitioned between a grading mode, dumping mode, and conveying mode.

Rotation of the bucket 10 is achieved with a bucket-pivoting member and a displacement body 28 having an output shaft 30 disposed therein. In a preferred embodiment, such as illustrated in FIGS. 1–5, the bucket-pivoting member has a first pivot arm 32 and second pivot arm 34. At one end, the first pivot arm 32 and second pivot arm 34 are each attached to the bucket 10. The other ends of the first pivot arm 32 and second pivot arm 34, generally extending above the bucket 10, are attached to each other.

The output shaft 30 is coupled at one end to the bucket-pivoting member. In a preferred embodiment, such as illustrated in FIGS. 1–5, the output shaft 30 is coupled at one end to the first pivot arm 32. Coupling of the output shaft 30 to the bucket-pivoting member can be, as illustrated in FIG. 5, achieved with a double lip and connecting pin. The other end of the output shaft 30 moves within the displacement body 28. Movement of the output shaft 30, in the form of inward and outward displacement within the displacement body 28, causes the rotation of the bucket 10 around the rotational center point 22, and as such the transitioning of the assembly between grading mode, dumping mode, and conveying mode. In other embodiments, more than one combination of displacement body 28 and output shaft 30 can be used to achieve rotation of the bucket 10 around the rotational center point 22. In such instances, the multiple displacement bodies and output shafts can work in tandem to achieve the same rotation of the bucket. Conversely, each of the combinations of displacement body and output shaft can be used to achieve rotation of the bucket in a single direction, either clockwise or counterclockwise. Rotation of the bucket, however can be achieved with a single combination of displacement body 28 and output shaft 30 and as such the use of a single combination of displacement body 28 and output shaft 30 is preferred.

Inward and outward displacement of the output shaft 30 within the displacement body 28 can be accompanied by a variety of techniques. Preferably, the movement of the output shaft is accomplished by the introduction and removal of a pressurized fluid from the displacement body 28, introduction of the fluid causing an increase in displacement of the output shaft 30 and removal of the fluid causing a decrease in displacement of the output shaft 30. As such, displacement body 28 will be adapted for the introduction and removal of the pressurized fluid, generally through the positioning of one or more ports on the displacement body 28. Control of the output shaft 30, such as by the introduction and removal of pressurized fluid, is controlled by an operator of the vehicle.

Use of a first pivot arm 32 and second pivot arm 34 as illustrated in FIGS. 1–5 is preferred as the amount of force required to rotate the bucket will generally decrease as the distance between the rotational center point 22 and any portion of the output shaft 30 or displacement body 28 is increased. Despite this preference, in other embodiments the bucket-pivoting member may consist of a single bracket directly connected to the bucket 10 and adapted for connection to the output shaft 30. Such a bracket can be placed on the upper portion of restraining wall 18. Alternatively, a single pivot arm generally extending above the bucket can be used as the bucket-pivoting member.

In the present embodiment, as well as other embodiments, of the invention, certain additional features can exist as a "matched set" of components. These include first wheel 36, second wheel 42, third wheel 44, bucket-rotational member 38, support arm 40, and extension arm 41. As illustrated in the FIG. 5, this refers to the use of mirrored components positioned on opposite sides of the bucket and designed to work in tandem to achieve the same result. While the use of such mirrored components is preferred as their use provides for more efficient operation of the bucket assembly, it is contemplated that a single component could be used to achieve the intended result. Likewise, the use of triplicate (or more) matched components is contemplated. Such modifications are believed to be within the skill of one of ordinary skill in the art having the benefit of the present disclosure and are, therefore, considered to be within the scope of the present invention. While, for convenience, the embodiments will be described with respect to a single component of the matched set, it should be understood that any duplicative components, if present, would be similarly characterized.

The bucket assembly has a set of matched first wheels 36, each consisting of both the wheel as well as any shaft or other mechanism used to achieve rotatable attachment of the wheel. Each of the first wheels 36 is rotatably connected to one end of a support arm 40. The wheels of the set of matched first wheels 36 are aligned such that their rotational centers are on the same horizontal axis. From the point of connection to first wheel 36, support arm 40 extends forward in direction 17. Support arm 40 is connected to an extension arm 41 of the bucket 10 at a point away from the point of connection to the first wheel 36. Such is illustrated in FIG. 5.

The bucket assembly additionally has a bucket-rotational member 38, preferably existing as matched set. Bucket-rotational member 38 is provided to stabilize the operation of the bucket assembly during the rotation of the bucket 10 through the grading, dumping, and conveying modes. In the present embodiment, the bucket-rotational member 38 is attached at one end to the bucket 10 at a point away from the working edge 12. Preferably this point of attachment is adjacent the retaining wall 18. In other embodiments, as described subsequently, bucket-rotational member 38 is directly attached to a set of matched second wheels provided adjacent the retaining wall 18. The mechanism of attachment to the set of matched second wheels does not impede rotation of the second wheels.

The second end of bucket-rotational member 38 is rotatably linked to first wheel 36 such that vertical displacement of first wheel 36 as it moves responsive to the transitioning of the bucket within the grading, dumping, and conveying modes results in a substantially equivalent vertical displacement of the second end of bucket rotational member 38. Bucket-rotational member 38 need not be directly attached to first wheel 36, although in certain embodiments it can be. The mechanism of attachment of the second end of bucket-rotational member 38 does not impede the rotation of the wheel or wheels of the set of matched first wheels 36. In a preferred embodiment, such as illustrated in FIGS. 1–5, the second end of bucket-rotational member 38 is rotatably attached to support arm 40. Support arm 40, as previously described, is connected at one end to and extends from first wheel 36, again in a manner that does not impede the rotation of first wheel 36. A welded shaft with a bushing can be used to rotatably attach the second end of bucket-rotational member 38 to support arm 40.

Figure 2:
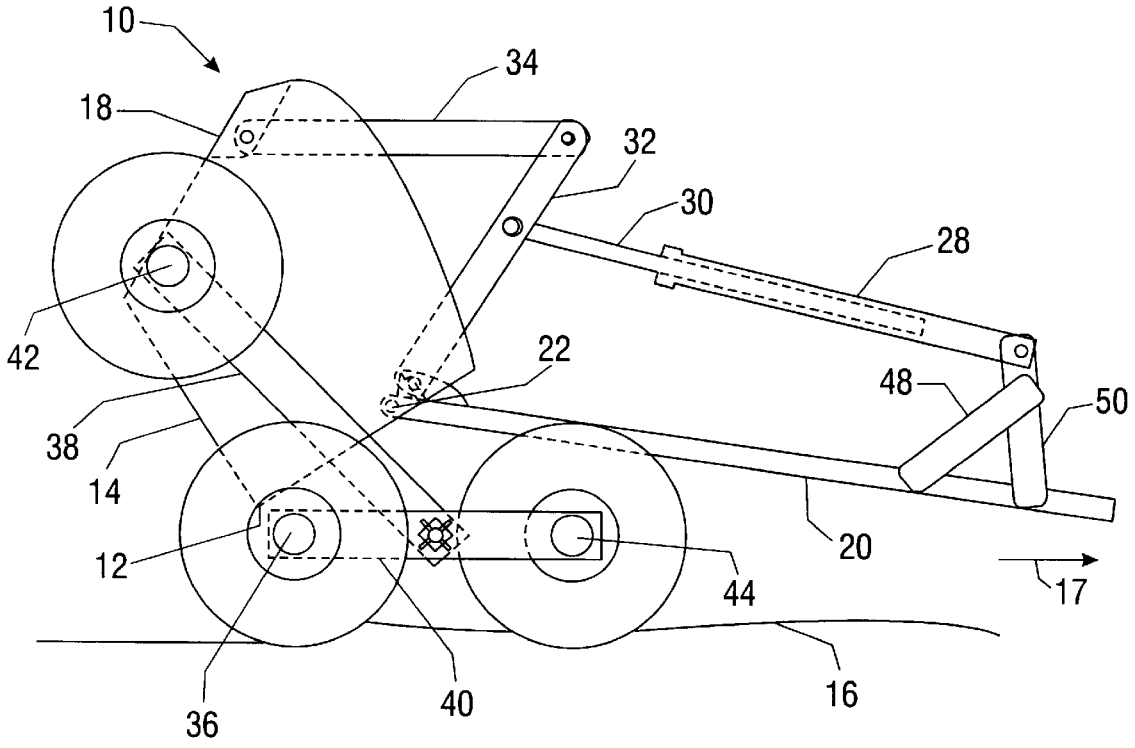
FIG. 2 is a depiction from the side of one embodiment of the tiltable bucket assembly in the dumping mode.
Figure 3:
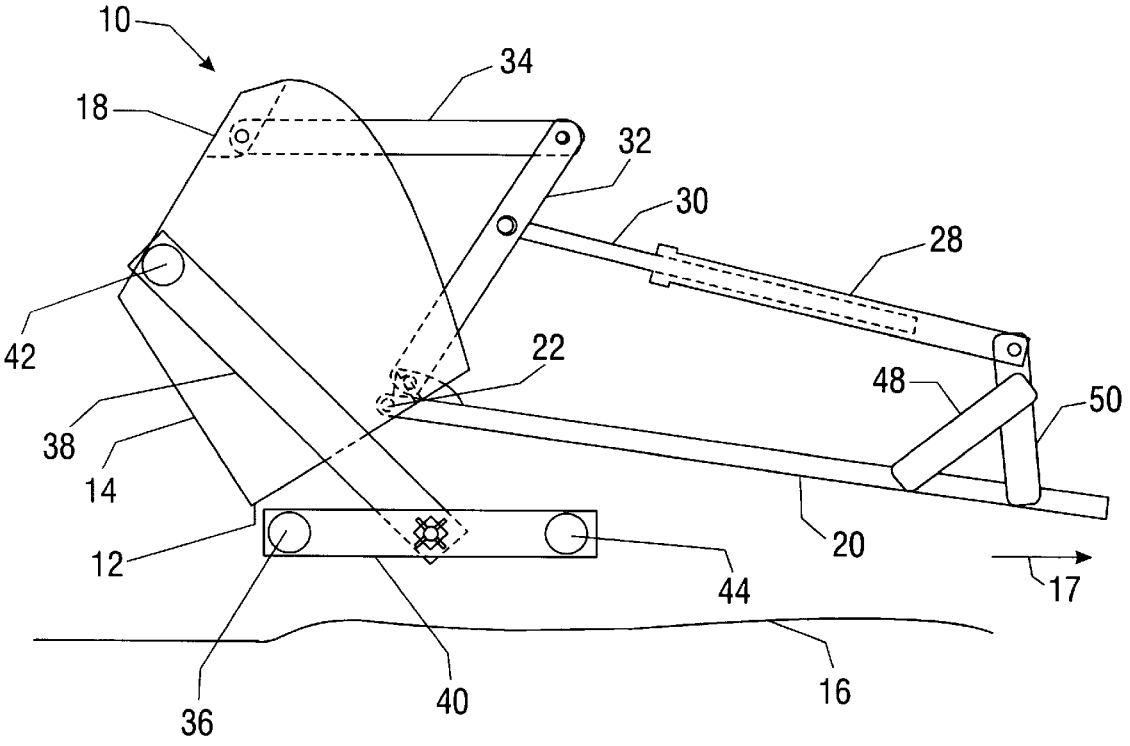
FIG. 3 is a depiction from the side of one embodiment of the tiltable bucket assembly in the dumping mode with wheels removed for illustrative purposes.

In the grading mode, the leading edge 12 will normally engage the surface to be worked 16. While in the grading mode, first wheel 36 will, likewise, normally engage the surface to be worked 16. In the grading mode, the output shaft 30 is positioned in a normal position, roughly approximating a median amount of displacement of the output shaft 30 within the displacement body 28. Decreased displacement of the output shaft 30 from this normal position causes the clockwise rotation of the bucket 10 around the rotational center point 22 into the dumping mode where the leading edge 12 of the bucket 10 will disengage from the surface to be worked 16 but first wheel 36 will continue to generally engage the surface to be worked 16. Such is illustrated in FIGS. 2 and 3. In FIG. 3, the wheels have been removed to more clearly demonstrate the rotation of the bucket 10 and the interrelationship of the various components in achieving same.

The bucket assembly, while in the grading mode, can be drawn over a distance accumulating soil as it is drawn. Once reaching a target site or area, the bucket assembly can be transitioned into the dumping mode, in which the accumulated soil can either be dumped in a discrete pile or piles if the bucket assembly is not in motion during dumping or, alternatively, spread out over a large area if the bucket assembly remains in motion during dumping. When the soil is spread out over a large area, the amount of soil applied to any one location can be controlled by varying the amount by which the working edge 12 is removed from the surface to be worked 16. Such is achieved by varying the displacement of output shaft 30. By varying this amount, the working edge 12 can be used to grade the dispensed soil to a specified height.

Figure 4:
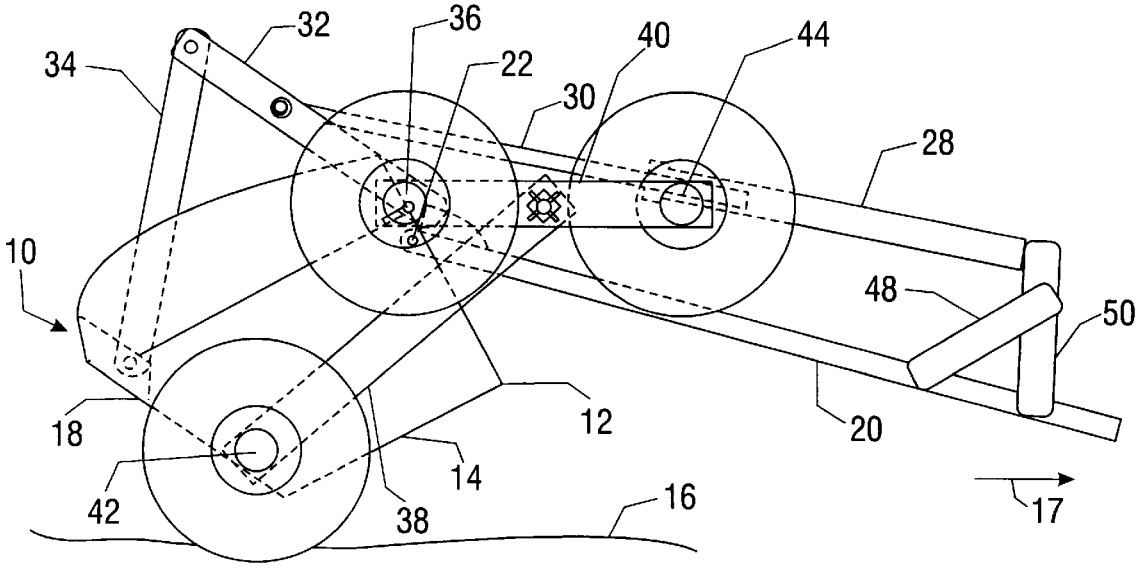
FIG. 4 is a depiction from the side of one embodiment of the tiltable bucket assembly in the conveying mode.

If rather than decreasing displacement of the output shaft 30 from the normal position, one were to increase the displacement of the output shaft 30 from the normal position, the bucket 10 would rotate counter-clockwise around the rotational center point 22 into the conveying mode. Such is illustrated in FIG. 4. In the conveying mode, any accumulated soil, having shifted away from the working edge 12 which is now disengaged from the surface to be worked 16, will preferentially reside in the space defined by the bottom wall 14 and retaining wall 18.

With the counter-clockwise rotation of the bucket 10, first wheel 36 moves vertically, disengaging the surface to be worked 16. As the purpose of the conveying mode is to enable transportation of the accumulated soil from one location to another without dispensing the soil over the entire distance, a set of matched second wheels 42 is provided. Second wheel 42 is attached to the bucket 10 and is positioned to the rear of the first wheel 36, preferably adjacent the retaining wall 18. Again, the wheels of the set of match second wheels 36 are aligned such that their rotational centers are on the same horizontal axis. The mechanism of attachment does not impede rotation of second wheel 42. In a particularly preferred embodiment, bucket-rotational member 38 is directly attached to second wheel 42 again in a manner that does not impede rotation of second wheel 42. Second wheel 42 is again preferably provided adjacent the retaining wall 18.

When in the grading mode, second wheel 42 will, like first wheel 36, preferably engage the surface to be worked 16. Such is illustrated in FIG. 1. However, this is not required. Second wheel 42 need only be positioned behind first wheel 36 such that when the displacement of the output shaft 30 is increased relative to the normal position, causing first wheel 36 to become disengaged from the surface to be worked 16, second wheel 42 remains engaged, or becomes engaged to the surface to be worked 16. Thus, in the conveying mode, second wheel 42 will bear the weight of the bucket assembly and the accumulated soil.

The bucket assembly need not be brought to a stop in order to transition the assembly between the various modes. However, it may be desirable to do so in order to reduce strain on the assembly. For example, it will generally be desirable to bring the assembly to a stop before transitioning the bucket into the grading mode, either from the conveying mode or the dumping mode. As the working edge 12 will be disengaged from the surface to be worked 16 when the assembly is either in the dumping or conveying modes, these two modes are generally utilized when the bucket assembly is being taken from a storage area into the area targeted for grading.

In other embodiments, a matched set of third wheels 44 is provided. Third wheel 44, when provided, works in tandem with first wheel 36. Specifically, like first wheel 36, third wheel 44 will while in the grading and dumping modes, remain normally engaged to the surface to be worked 16. As such, third wheel 44 will preferably be attached to one end of support arm 40 which is attached at the other end to first wheel 36. The mechanism of attachment does not impede the rotation of third wheel 44.

In various embodiments, the displacement body 28 may be directly coupled to the bucket linking arm 20, such as by connecting arms 48 and 50. Indeed, such coupling is preferred so as to provide additional support to the displacement body 28 and output shaft 30. In other embodiments, vertical or horizontal stabilization members, or both, will be provided to add structural stability to bucket 10.

In a preferred embodiment, the bucket assembly can be adapted to vary the depth of the cut of the working edge 12 while in the grading mode. Such can be done, by adjusting the difference between the height of the working edge 12 relative to the lowest point of contact between the surface to be worked 16 and any wheel. Such difference is judged while the assembly is in the grading mode. Because of their proximity to the bucket compared to the third wheel 44, either the first wheel 36 or second wheel 42 will generally control the gauge of the cut of the bucket assembly.

What is claimed is:

1. A tiltable bucket assembly comprising:

a bucket having a working edge, a pair of forward extending extension arms, a pair of support arms, a pair of first wheels, a pair of second wheels, a pair of bucket-rotational members, a bucket-pivoting member, a bucket-linking arm, and a displacement body having an output shaft disposed therein;

wherein each support arm is connected at one end to and extends forward from the corresponding first wheel and wherein each extension arm is connected to the corresponding support arm at a point away from the corresponding first wheel;

wherein each bucket-rotational member is attached at one end to the bucket at a point away from the working edge and wherein the other end is linked to the corresponding first wheel so that vertical displacement of the first wheel results in a substantially equivalent vertical displacement of the other end of the bucket-rotational member;

wherein the bucket-linking arm is coupled at one end to the bucket at a rotational center-point positioned above the working edge;

wherein the output shaft is coupled at one end to the bucket-pivoting member and wherein the other end moves within the displacement body, movement of said output shaft causing the rotation of the bucket, said rotation causing the assembly to be alternatively transitioned between a grading mode, a dumping mode, and a conveying mode;

wherein each of said second wheels is connected to said bucket at a point away from said working edge.

2. The bucket assembly of claim 1 wherein each bucket-rotational member is attached at one end to the bucket at a point away from the working edge and wherein the other end is directly and rotatably attached to the corresponding first wheel.

3. The bucket assembly of claim 1, wherein each bucket-rotational member is attached at one end to the bucket at a point away from the working edge and wherein the other end is rotatably attached to the corresponding support arm at a point away from the corresponding first wheel.

4. The bucket assembly of claim 1, wherein the assembly additionally comprises a pair of third wheels, each attached to the corresponding support arm.

5. The bucket assembly of claim 4, wherein each bucket-rotational member is attached at one end to the bucket at a point away from the working edge and wherein the other end is directly and rotatably attached to the corresponding first wheel.

6. The bucket assembly of claim 4, wherein each bucket-rotational member is attached at one end to the bucket at a point away from the working edge and wherein the other end is rotatably attached to the corresponding support arm at a point away from the corresponding first wheel.

7. The bucket assembly of claim 1, the bucket-pivoting member comprising first and second pivot arms each attached to the bucket at one end and attached to each other at the other end.

8. The bucket assembly of claim 1, wherein the displacement body is connected to the bucket-linking arm.

9. The bucket assembly of claim 1, wherein the other end of the bucket-linking arm is adapted for connection to a vehicle.

10. The bucket assembly of claim 1, wherein the displacement body is adapted for receiving and removing pressurized fluid so as to cause the movement of the output shaft.

11. The bucket assembly of claim 1, wherein in said grading mode said working edge normally engaging a surface to be worked and said output shaft being positioned in a normal position and wherein decreased displacement of the output shaft from said normal position causes the clockwise rotation of the bucket around the rotational center-point into the dumping mode and wherein increased displacement of the output shaft from said normal position causes the counter-clockwise rotation of the bucket around the rotational center-point into the conveying mode.

12. A tiltable bucket assembly comprising:

a bucket having a working edge, a pair of forward extending extension arms, a pair of support arms, a pair of first wheels, a pair of second wheels, and a pair of third wheels, a pair of bucket-rotational members, a bucket-pivoting member, a bucket-linking arm, and a displacement body having an output shaft disposed therein;

wherein each support arm is connected at one end to the corresponding first wheel and extends forward from this corresponding first wheel where it is connected to the corresponding third wheel;

wherein each extension arm is connected to the corresponding support arm at a point away from the corresponding first wheel;

wherein each bucket-rotational member is attached at one end to the bucket at a point away from the working edge and wherein the other end is rotatably attached to the corresponding support arm at a point between the corresponding first wheel and the corresponding third wheel;

wherein the bucket-linking arm is coupled at one end to the bucket at a rotational center-point positioned above the working edge;

wherein the output shaft is coupled at one end to the bucket-pivoting member and wherein the other end moves within the displacement body, movement of said output shaft causing the rotation of the bucket, said rotation causing the assembly to be alternatively transitioned between a grading mode, a dumping mode, and a conveying mode;

wherein each of said second wheels is connected to said bucket at a point away from said working edge.

* * * * *